US010737823B2

(12) United States Patent
Palmer et al.

(10) Patent No.: US 10,737,823 B2
(45) Date of Patent: Aug. 11, 2020

(54) CONTAINER AND METHOD OF MANUFACTURING THE SAME

(71) Applicants: Milacron LLC, Cincinnati, OH (US); Consolidated Container Company LP, Atlanta, GA (US)

(72) Inventors: Joey Palmer, Marietta, GA (US); James Janeczek, Tecumseh, MI (US)

(73) Assignees: Milacron LLC, Cincinnati, OH (US); Altium Packaging LP, Atlanta, GA (US)

( * ) Notice: Subject to any disclaimer, the term of this patent is extended or adjusted under 35 U.S.C. 154(b) by 0 days.

(21) Appl. No.: 16/456,980

(22) Filed: Jun. 28, 2019

(65) Prior Publication Data

US 2019/0315508 A1 Oct. 17, 2019

Related U.S. Application Data

(63) Continuation of application No. 15/850,178, filed on Dec. 21, 2017, now Pat. No. 10,384,824.

(51) Int. Cl.
*B65D 1/02* (2006.01)
*B65D 23/10* (2006.01)
*B65D 47/12* (2006.01)

(52) U.S. Cl.
CPC ..... *B65D 1/0261* (2013.01); *B65D 1/0223* (2013.01); *B65D 1/0284* (2013.01);
(Continued)

(58) Field of Classification Search
CPC .. B65D 1/0261; B65D 1/0223; B65D 1/0284; B65D 23/10; B65D 47/122; B65D 2501/0081
(Continued)

(56) References Cited

U.S. PATENT DOCUMENTS

D195,697 S 7/1963 Price et al.
D197,190 S 12/1963 Natale et al.
(Continued)

FOREIGN PATENT DOCUMENTS

WO WO 1998/033712 A1 8/1998

OTHER PUBLICATIONS

U.S. Patent and Trademark Office, Notice of Allowance for U.S. Appl. No. 29/645/266, dated Oct. 2, 2019, (16 pages), USA.
(Continued)

*Primary Examiner* — Paul R Durand
*Assistant Examiner* — Andrew P Bainbridge
(74) *Attorney, Agent, or Firm* — Alston & Bird LLP

(57) ABSTRACT

A container may comprise a spout, a base portion, and an ovular sidewall extending away from the base portion to the spout. The ovular sidewall comprises a vertical portion, a top transition region, and a top region extending from the top transition region to the spout. The top region comprises at least two discrete linear sections having different slopes between the top transition region and the spout. Moreover, the base portion of the container defines a support surface on which the container rests, a base channel extending across the diameter of the container, and an inset concave panel aligned with a center of the container. The container additionally comprises a handle portion defining a complex-curved face surface interrupting the top transition region and the top region, and a handle extending from a bottom portion of the face surface to a top portion of the face surface.

20 Claims, 7 Drawing Sheets

(52) U.S. Cl.
CPC ..... *B65D 23/10* (2013.01); *B65D 47/122* (2013.01); *B65D 2501/0081* (2013.01)

(58) Field of Classification Search
USPC ..... 222/465.1
See application file for complete search history.

(56) References Cited

U.S. PATENT DOCUMENTS

| | | | | |
|---|---|---|---|---|
| D201,051 | S | | 5/1965 | Shepler et al. |
| D201,103 | S | | 5/1965 | Caisse et al. |
| D203,560 | S | | 1/1966 | Erickson et al. |
| D204,701 | S | | 5/1966 | Shepler et al. |
| D208,824 | S | | 10/1967 | Platte et al. |
| D213,821 | S | | 4/1969 | Platte |
| D215,410 | S | | 9/1969 | Hills et al. |
| D229,296 | S | | 11/1973 | Cutler et al. |
| D238,654 | S | | 2/1976 | Platte et al. |
| D250,995 | S | | 2/1979 | Beaver |
| 4,372,455 | A | | 2/1983 | Cochran |
| D286,379 | S | | 10/1986 | Lyons |
| D309,421 | S | | 7/1990 | Aldrich, III |
| 4,964,522 | A | | 10/1990 | Umetsu et al. |
| D348,612 | S | * | 7/1994 | Ring ..... D9/531 |
| D379,929 | S | | 6/1997 | Dallaire |
| D391,854 | S | | 3/1998 | Ankney et al. |
| 5,833,115 | A | | 11/1998 | Eiten |
| 6,068,161 | A | | 5/2000 | Soehnlen et al. |
| D427,076 | S | | 6/2000 | Ankney et al. |
| 6,237,792 | B1 | | 5/2001 | Skolnicki et al. |
| D470,417 | S | | 2/2003 | Anderson |
| 6,527,133 | B1 | | 3/2003 | McCollum et al. |
| 6,588,612 | B1 | | 7/2003 | Dorn et al. |
| D485,497 | S | | 1/2004 | Steele, IV et al. |
| D488,721 | S | | 4/2004 | Peronek |
| 6,889,858 | B2 | | 5/2005 | Mccollum et al. |
| 7,059,486 | B2 | | 6/2006 | Van Der Heijden et al. |
| D593,863 | S | | 6/2009 | Fahy et al. |
| 7,686,168 | B1 | | 3/2010 | Smiley et al. |
| 7,699,171 | B2 | | 4/2010 | Rivera et al. |
| 8,047,392 | B2 | | 11/2011 | Eiten et al. |
| D662,421 | S | | 6/2012 | Dorn |
| 8,276,775 | B2 | | 10/2012 | Boukobza |
| D678,072 | S | | 3/2013 | Lobbestael et al. |
| D685,641 | S | | 7/2013 | Tomkins et al. |
| D686,080 | S | | 7/2013 | Tomkins et al. |
| 8,535,599 | B1 | | 9/2013 | Lobbestael et al. |
| 8,668,101 | B2 | | 3/2014 | Lobbestael et al. |
| 8,893,908 | B2 | | 11/2014 | Treece et al. |
| 8,979,524 | B2 | | 3/2015 | Lobbestael et al. |
| D733,566 | S | | 7/2015 | Lobbestael et al. |
| D739,248 | S | | 9/2015 | Janeczek |
| D742,747 | S | | 11/2015 | Lobbestael et al. |
| 9,446,551 | B2 | | 9/2016 | Lobbestael et al. |
| D800,567 | S | | 10/2017 | Palmer et al. |
| 9,981,768 | B1 | | 5/2018 | Palmer |
| D823,690 | S | | 7/2018 | Palmer et al. |
| D823,691 | S | | 7/2018 | Palmer et al. |
| 10,384,824 | B2 | | 8/2019 | Palmer et al. |
| D874,284 | S | | 2/2020 | Palmer et al. |
| D874,940 | S | | 2/2020 | Janeczek et al. |
| 2003/0006210 | A1 | | 1/2003 | Iizuka et al. |
| 2003/0155324 | A1 | | 8/2003 | McCollum et al. |
| 2003/0230545 | A1 | | 12/2003 | Mount et al. |
| 2004/0094502 | A1 | | 5/2004 | Boukobza |
| 2005/0082251 | A1 | | 4/2005 | Darr et al. |
| 2006/0260971 | A1 | | 11/2006 | Rivera et al. |
| 2007/0023384 | A1 | | 2/2007 | Janeczek |
| 2010/0089863 | A1 | | 4/2010 | Matsuoka |
| 2011/0132863 | A1 | | 6/2011 | Dorn |
| 2011/0284541 | A1 | * | 11/2011 | Webster ..... B65D 23/10 220/288 |
| 2012/0241405 | A1 | | 9/2012 | Lobbestael et al. |
| 2013/0001234 | A1 | | 1/2013 | Glover |
| 2013/0243896 | A1 | | 9/2013 | Lobbestael et al. |
| 2015/0014274 | A1 | | 1/2015 | Glover |
| 2016/0272356 | A1 | | 9/2016 | Simpson et al. |
| 2017/0158370 | A1 | | 6/2017 | Kuhar et al. |
| 2018/0244423 | A1 | | 8/2018 | Palmer et al. |
| 2019/0193890 | A1 | | 6/2019 | Palmer et al. |

OTHER PUBLICATIONS

Canadian Intellectual Property Office, Examiner's Report for Application No. 181964, dated Jul. 23, 2018, 2 pages, Canada.
European Union Intellectual Property Office, Examination Report for Application Nos. 005316882-0001/005316882-0003, dated Aug. 14, 2018, 1 page, Spain.
Canadian Intellectual Property Office, Requisition by the Examiner for Application No. 3,009,203, dated Sep. 6, 2018, 3 pages, Canada.
United States Patent and Trademark Office, Notice of Allowance for U.S. Appl. No. 29/707,435, dated Nov. 29, 2019, (13 pages), USA.
U.S. Patent and Trademark Office, Notice of Allowance for U.S. Appl. No. 29/720,583, dated Apr. 7, 2020, (8 pages), USA.

* cited by examiner

CONTAINER AND METHOD OF MANUFACTURING THE SAME

CROSS-REFERENCE TO RELATED APPLICATIONS

This patent application is a continuation of U.S. patent application Ser. No. 15/850,178 filed Dec. 21, 2017, which is incorporated herein by reference in their entirety.

BACKGROUND

Containers that may be used to enclose and transport fluids are often subject to significant stresses during use. Such containers may be dropped while full or partially full of fluid, stacked on top of one another, supported in a suspended configuration (e.g., when held by a user), and/or the like. Accordingly, various containers incorporate strengthening features in order to provide strength to the container against breakage.

However, containers may be subject to additional limitations, such as a requirement to minimize the cost of materials in the containers, the weight of materials in the containers, and/or the like. Accordingly, container configurations often are subject to generally conflicting design considerations of maximizing the strength of the container while minimizing the cost and/or weight of materials in the container.

Accordingly, a need exists for containers providing an optimal balance of maximum strength against undesired breakage while minimizing the cost and/or weight of materials in the container.

BRIEF SUMMARY

Certain embodiments are directed to high-strength blow-molded containers having a thin overall sidewall thickness. The container may be particularly suitable for storing and transporting industrial fluids, such as solvents, cleaners, automotive fluids, and/or the like. The container may have a multi-angle top portion configured to distribute vertical compression loads received by the container over a large surface area of the container sidewalls to avoid common crush-failure points surrounding the spout. Moreover, the container includes an integrated handle having similar crush-resistant properties through the introduction of gradual, large radius curves between the handle and adjacent portions of the container, and via the placement of the handle portion outside of the circumference of the spout, such that vertical crushing loads do not create a large localized crushing stress on the bottom proximate a perimeter of the container portion.

Various embodiments are directed to a container comprising: a base portion configured to support the container in an upright orientation relative to a support surface and wherein the base portion defines an at least substantially ovular perimeter; a spout positioned opposite the base portion and oriented such that a centerline of the spout is aligned with a centerline of the base portion; an ovular sidewall extending between the perimeter of the base portion to the spout, wherein the ovular sidewall defines: a vertical portion extending away from the base portion; a downward sloping linear top portion extending away from the spout and toward the vertical portion; and a gradually curved transition region extending between the vertical portion and the downward sloping linear top portion, wherein the gradually curved transition region defines a continuously variable radius of curvature having an at least substantially linear portion adjacent the downward sloping linear top portion; wherein the vertical portion is inset relative to the gradually curved transition region and the base portion; and wherein the downward sloping linear top portion has a steeper slope than the at least substantially linear portion of the gradually curved transition region.

In certain embodiments, the sidewall defines an at least substantially uniform wall thickness through the vertical portion, top transition region, and downward sloping top portion. Moreover, the ovular sidewall may further define a curved base transition region extending between the base portion and the vertical portion, and wherein the vertical portion is inset relative to the curved base transition region. The container may also comprise a handle portion defining a handle cavity within the downward sloping top portion and the top transition region; a face surface extending across the handle cavity; and a handle comprising an upper portion adjacent the spout and a lower portion adjacent the vertical portion of the sidewall.

The ovular base may define a major diameter measured across the container and aligned with a first center plane of the container and a minor diameter measured across the container and aligned with a second center plane perpendicular to the first center plane, wherein the major diameter is longer than the minor diameter; and wherein the handle may be aligned with the first center plane. In certain embodiments, the handle and face surface are spaced a horizontal distance away from a third plane, wherein the third plane is parallel with the second plane and tangent to the spout such that the spout is positioned on a first side of the third plane and the handle and face surface are positioned on a second side of the third plane. Moreover, the face surface may be bound by a convex perimeter curve joining the face surface with the downward sloping top portion and the top transition region. Moreover, the convex perimeter curve may be bounded by a perimeter groove positioned between the convex perimeter curve and the top portion and top transition region.

Certain embodiments are directed to a container comprising: a base portion configured to support the container in an upright orientation relative to a support surface and wherein the base portion defines an at least substantially ovular perimeter having a major diameter and a minor diameter measured perpendicular to the major diameter, wherein the major diameter is larger than the minor diameter; a spout positioned opposite the base portion and oriented such that a centerline of the spout is aligned with a centerline of the base portion; an ovular sidewall extending between the perimeter of the base portion to the spout, wherein the ovular sidewall defines: a vertical portion extending away from the base portion; a downward sloping top portion extending away from the spout and toward the vertical portion; a gradually curved transition region extending between the vertical portion and the downward sloping linear top portion; and a curved base transition region extending between the base portion and the vertical portion; and wherein the base portion defines: a base channel extending across the base portion and aligned with the major diameter, wherein the base channel has a first depth extending toward an interior of the container; and an ovular inset panel oriented such that a centerline of the ovular inset panel is aligned with the centerline of the base portion, wherein the ovular inset panel has a second depth extending toward the interior of the container, wherein the second depth is greater than the first depth.

In certain embodiments, the vertical portion of the ovular sidewall is inset relative to the gradually curved transition region and the base portion. Moreover, the ovular inset panel may be concave and may have a centerpoint aligned with the centerline of the base portion and inset relative to a perimeter of the ovular inset panel toward the interior of the container. In certain embodiments, the base portion defines a support ring configured to support the container in the upright configuration, wherein the support ring surrounds the ovular inset panel and has an at least substantially uniform width measured between the perimeter of the container and a perimeter of the ovular inset panel; and wherein the base channel interrupts the support ring. Moreover, the curved base transition region may define an inflection point defining a convex peak surrounding the perimeter of the container, and wherein the inflection point transitions from a high position aligned with the minor axis to a low position aligned with the major axis.

Certain embodiments are directed to a container comprising: a base portion configured to support the container in an upright orientation relative to a support surface and wherein the base portion defines an at least substantially ovular perimeter having a major diameter and a minor diameter measured perpendicular to the major diameter, wherein the major diameter is larger than the minor diameter; a spout positioned opposite the base portion and oriented such that a centerline of the spout is aligned with a centerline of the base portion; an ovular sidewall extending between the perimeter of the base portion to the spout, wherein the ovular sidewall defines: a vertical portion extending away from the base portion; a downward sloping top portion extending away from the spout and toward the vertical portion; and a gradually curved transition region extending between the vertical portion and the downward sloping linear top portion; and a handle portion defining: a handle cavity within the downward sloping top portion and the top transition region; a face surface extending across the handle cavity; and a handle comprising an upper portion adjacent the spout and a lower portion adjacent the vertical portion of the sidewall; wherein the vertical portion is inset relative to the gradually curved transition region and the base portion; and wherein the face surface of the handle portion is spaced a horizontal distance away from the spout.

In certain embodiments, the major diameter is aligned with a first center plane of the container and the minor diameter is aligned with a second center plane perpendicular to the first center plane, wherein the handle is aligned with the first center plane, and the face surface of the handle portion is spaced away from the spout by a distance measured parallel to the major axis. Moreover, various embodiments of the face surface are bounded by a convex perimeter curve joining the face surface with the downward sloping top portion and the top transition region. In certain embodiments, the convex perimeter curve is bounded by a perimeter groove positioned between the convex perimeter curve and the top portion and top transition region. Moreover, in certain embodiments the upper portion of the handle intersects the convex perimeter curve at a first position proximate the spout and the lower portion of the handle intersects the convex perimeter curve at a second position proximate the vertical portion of the sidewall. In certain embodiments the lower portion of the handle further comprises a protruding strap portion interrupting the perimeter groove. Moreover, the protruding strap portion may be hollow.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
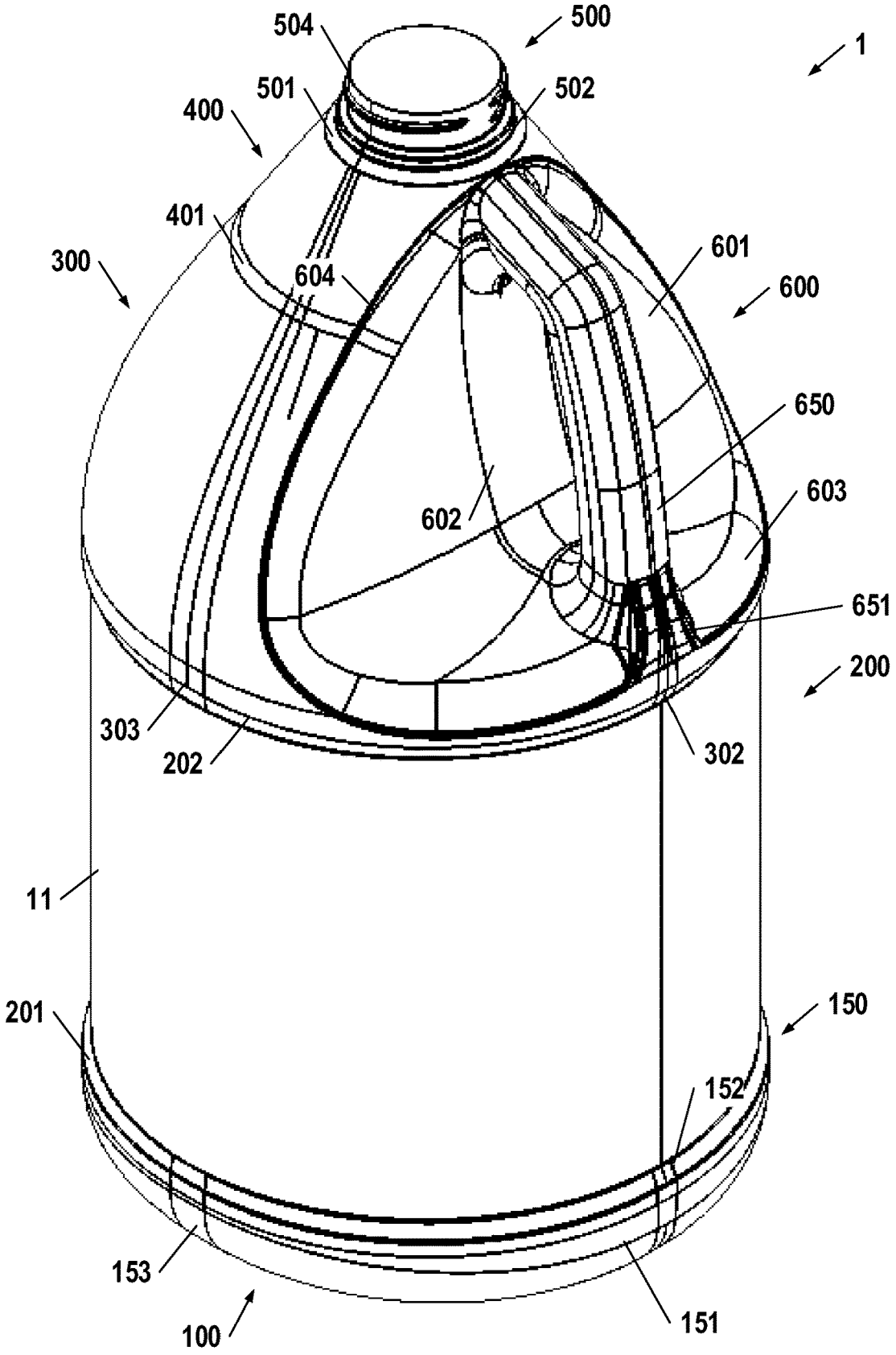
FIGS. 1-7 show various perspective views of a container according to various embodiments.

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Overview

Described herein is a container configured to enclose a fluid and/or other substance. The container comprises a plurality of strengthening features that provide desirable strength characteristics while minimizing the required amount of material necessary to construct the container having the desired strength characteristics. For example, various strengthening features may extend across planar surfaces, curved surfaces, and/or complex curved surfaces in order to provide crush resistance, tensile strength, and/or the like for the container. In various embodiments, the container may comprise a plastic material (e.g., High-Density Polyethylene (HDPE)). As a non-limiting example, the container may comprise at least about 70-90 g of material to provide a container having an interior volume of at least substantially 1 gallon; substantially larger or smaller containers may be formed or provided, with structural features beyond size/dimension otherwise as detailed herein.

As discussed herein, the container may define an at least substantially ovular base-perimeter having an at least substantially ovular sidewall extending therefrom. The sidewall may extend from a base portion (e.g., from a base transition region), through a vertical region, through a top transition region, through a top region, and to a spout. In various embodiments, the container may additionally define a handle portion encompassing a portion of the top region. The handle portion may be defined as a handle cavity and a handle, thereby providing a portion enabling a user to comfortably hold the container.

The container may be extrusion blow-molded. In various embodiments, the container may be constructed by placing (e.g., injecting) a parison within a container mold, wherein the container mold has an interior surface corresponding to the shape of the container. In various embodiments, the container mold may comprise two mold shells that collectively define the entirety of the mold. The mold shells may be symmetrical and have corresponding features, and accordingly the resulting container may be symmetrical across one or more planes.

The following description of a container is divided into various portions of the container for purposes of clarity, however it should be understood that such divisions should not construed as limiting, as one or more containers according to various embodiments may be constructed as a single continuous part. Moreover, the following description provides various dimensions for an example embodiment. These dimensions should not be construed as limiting, and are instead provided as example dimensions an example embodiment.

Container Construction

In various embodiments, the container 1 may comprise an at least semi-rigid material. Semi-rigid containers 1 may be configured to flex when exposed to externally applied forces, and/or rigid containers 1 may be configured to resist substantial flexing when subject to externally applied forces. For example, the container 1 may comprise plastic or other rigid or semi-rigid material. As just one specific example, the container 1 may comprise HDPE. As will be discussed herein, the container may be extrusion blow-molded. In such embodiments, the container 1 may comprise at least approximately 70-90 g of material to provide a 1-gallon interior volume container. As a specific example, a 1-gallon container may comprise at least approximately 80 g of material. As other example embodiments, the container 1 may comprise at least approximately 40-50 g (e.g., 45 g) of material for a ½-gallon interior volume container, and/or at least approximately 50-60 g (e.g., 55 g) of material for a 96-ounce interior volume container.

Except as otherwise discussed herein, the container 1 may have an at least substantially uniform wall thickness (extending between the interior of the container 1 and the exterior surface of the container 1) of at least approximately 0.009" to 0.050" (e.g., between about 0.015" to 0.020"). Accordingly, each sidewall may have an at least substantially uniform wall thickness between the vertical portion 200, top transition region 300, and top portions 400 (each described in greater detail herein). In various embodiments, the container 1 may be configured to resist a vertical crushing force of between about 150-160 lbf of force with about a 0.25 inch deflection in overall height of the bottle when filled and having a cap secured onto a spout thereof before breaking. Moreover, the container 1 may be configured to fall from a height of at least 3 feet while filled with fluid onto a hard surface without breaking.

Figure 5:
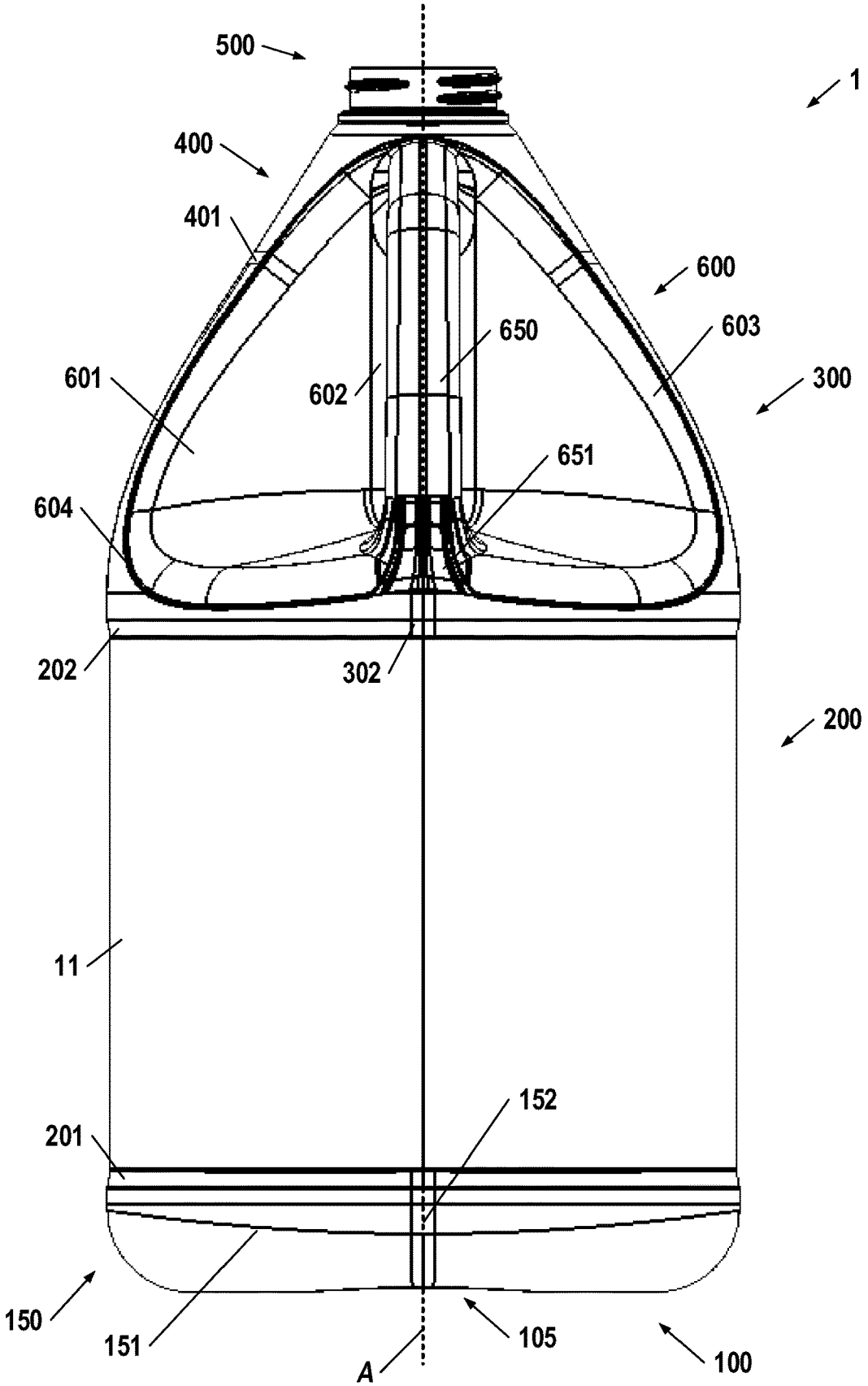
Figure 6:
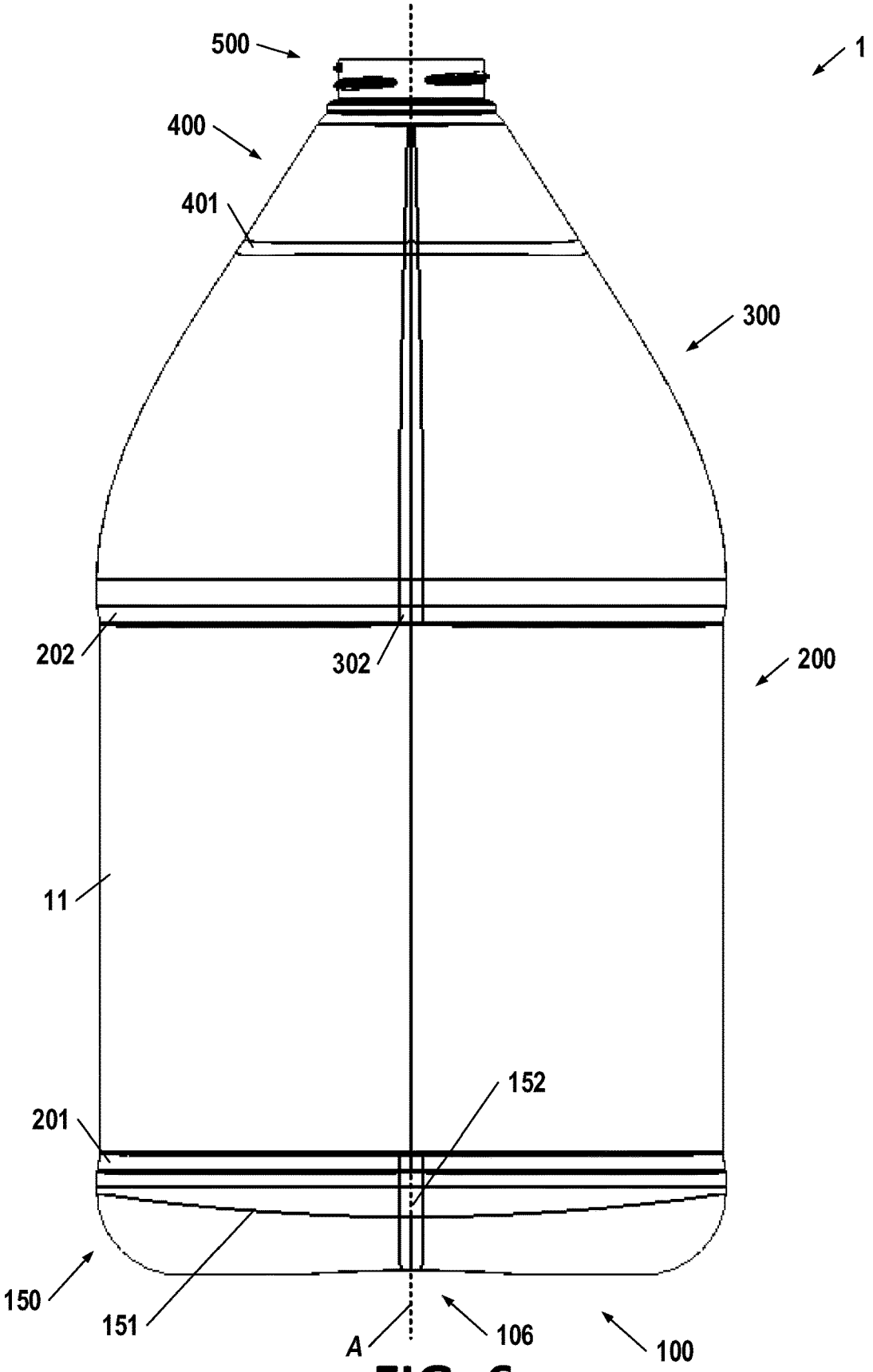

As will be discussed herein with reference to specific contours of the container 1, the container 1 may define a symmetry plane A extending through the center of the container. In various embodiments, the container may be at least substantially symmetrical about the symmetry plane A (except as specifically noted herein), such that contours on a first side of the symmetry plane A are equal and opposite to contours on a second side of the symmetry plane A. As illustrated in FIG. 5, the symmetry plane A may extend through a center of a handle portion 600 and spout 500.

Base Portion 100

Figure 2:
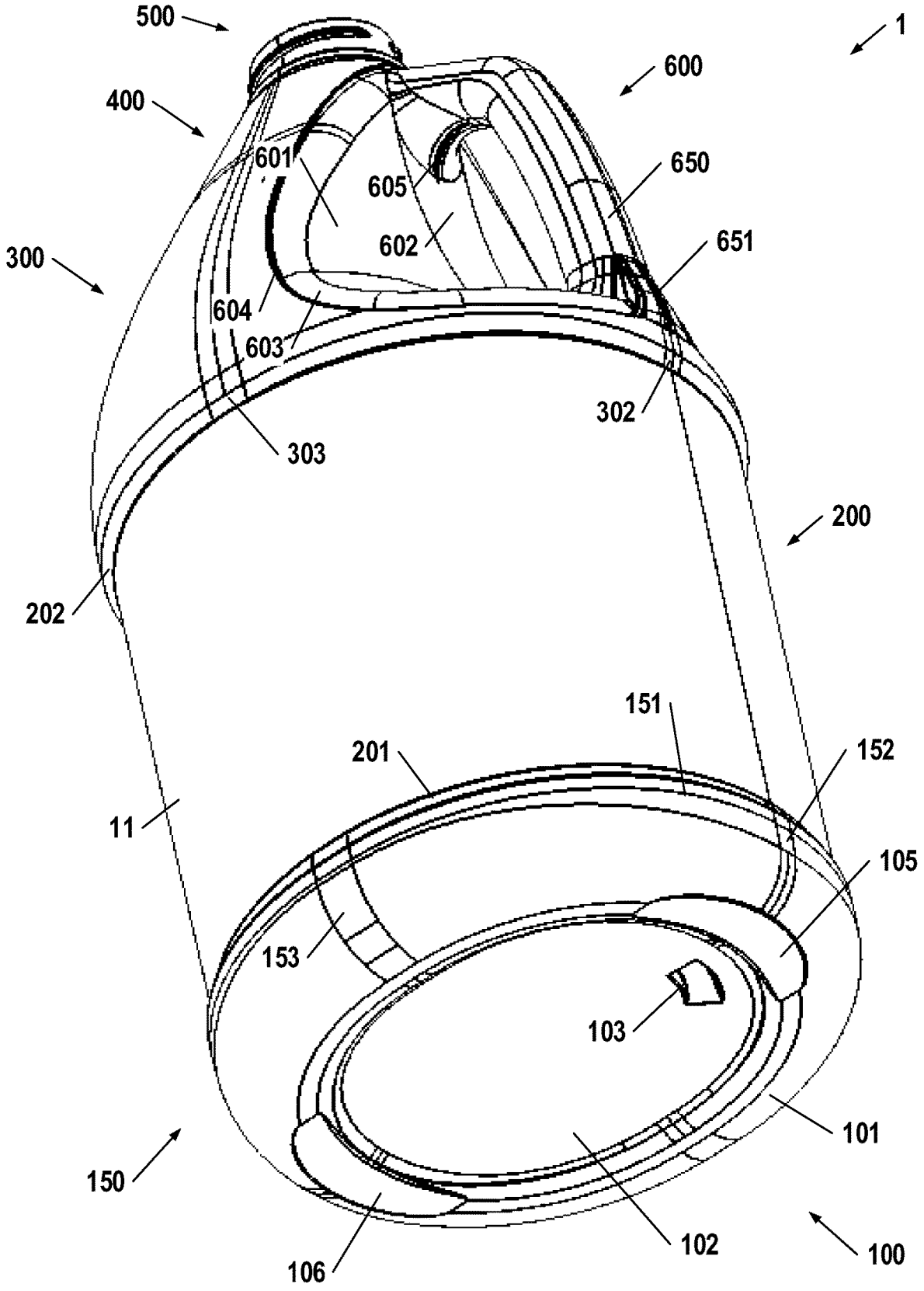
Figure 3:
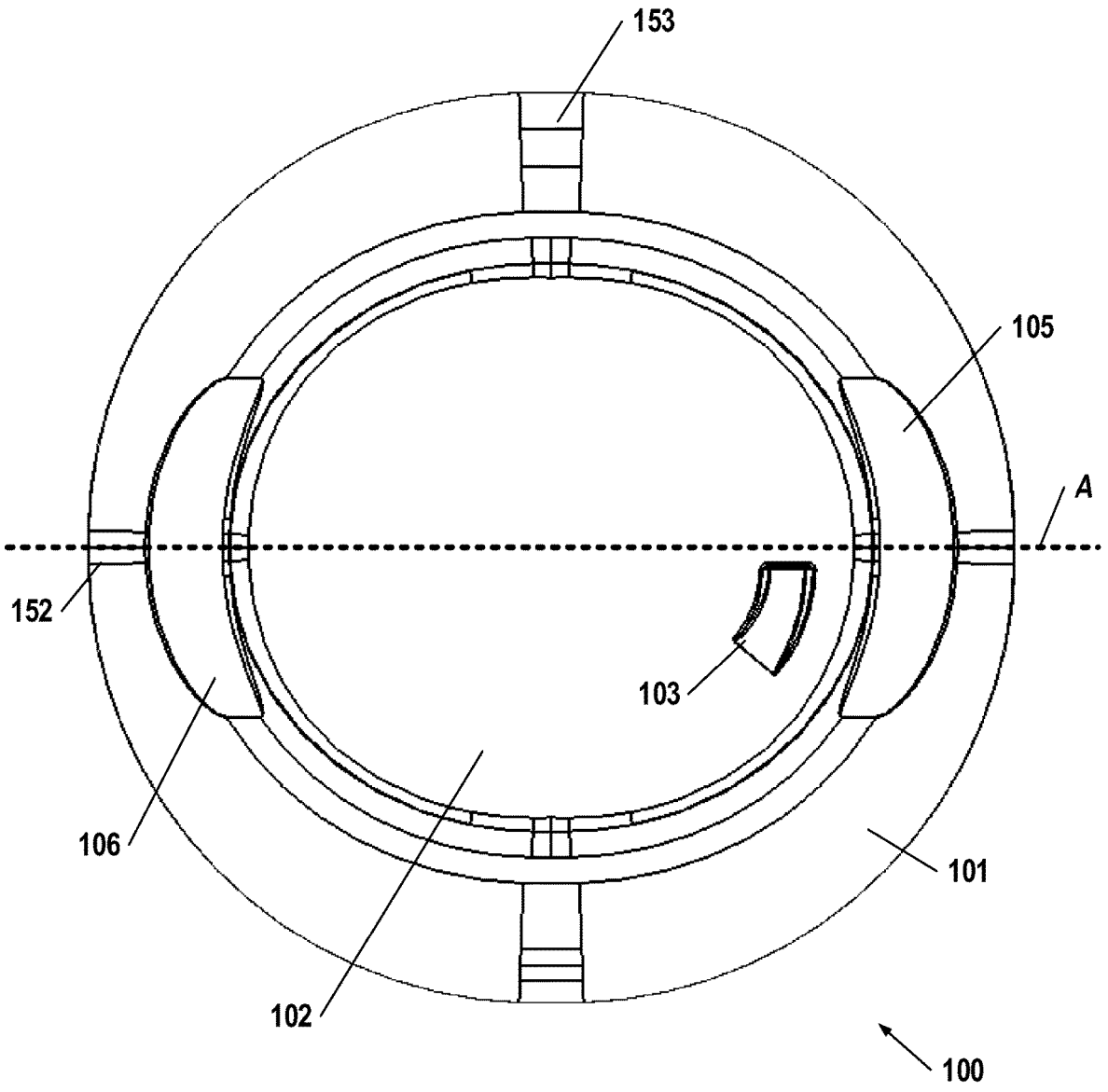

As illustrated in FIGS. 1-7, a container 1 according to various embodiments may be supported in an upright configuration by a base portion 100 relative to a horizontal support surface. With reference specifically to FIGS. 2-3, the base portion 100 defines a plurality of surface contours configured to provide strength to a bottom portion of the container 1. The base portion 100 may be defined between a base transition region 150 extending around the perimeter of the container 1. In various embodiments, the base transition region 150 may define a radius of curvature between the sidewall 11 and the base portion 100 around the entire perimeter of the container 1 (with exceptions, for example, resulting from the presence of one or more channels extending through the base transition region 150) extending between the base portion 100 and the container sidewall 11. As just one non-limiting example, the base transition region 150 may have a radius of at least approximately 0.5" to 0.8". The radius of curvature of the base transition region 150 may change at an inflection point 151 within the base transition region 150. In various embodiments, the inflection point 151 may be embodied as a convex peak extending outward away from the container 1. As shown in FIGS. 1-2, the inflection point 151 extends entirely around the perimeter of the container 1, and the location of the inflection point 151 may oscillate between a top edge and bottom edge of the base transition region 150 around the perimeter of the container 1. For example, the inflection point 151 may be located proximate the top edge of the base transition region 150 at portions of the base transition region 150 aligned with a first side of the container 1, and the inflection point 151 may be located proximate the bottom edge of the base transition region 150 at portions of the base transition region 150 aligned with the handle portion 600. Thus, the high points of the inflection point 151 (along the height of the base transition region 150) may be spaced at least approximately 180 degrees around the perimeter of the container 1, and the low points of the inflection point 151 (along the height of the base transition region 150) may likewise bet spaced approximately 180 degrees around the perimeter of the container 1, and may be spaced at least approximately 90 degrees around the perimeter of the container 1 relative to the location of the high points of the inflection point 151. Thus, the inflection point 151 may be embodied as a continuous ring, and may be symmetric across the symmetry plane A.

Moreover, the base transition region 150 may comprise spacing portions 152, 153 spaced around the perimeter of the base transition region 150. As shown in the figures, the spacing portions 152, 153 may be spaced at approximately 90 degrees relative to one another around the perimeter of the container 1. The spacing portions 152, 153 are defined as portions of the base transition region 150 having an interrupted radius of curvature. As shown, the spacing portions 152, 153 comprise first spacing portions 152 and second spacing portions 153, wherein the first spacing portions 152 have a first width (measured along the circumference of the base transition region 150) and the second spacing portions 153 have a second width (measured along the circumference of the base transition region 150). In certain embodiments, the spacing portions 152, 153 may have an at least substantially identical radius of curvature between the base portion 100 and the vertical portion 200, but may have a different radius of curvature measured around the perimeter of the base portion 100 than other portions of the base transition region 150. In certain embodiments, the spacing portions 152, 153 may be at least substantially planar portions of the perimeter of the base transition region 150. Due at least in part to the inclusion of the spacing portions 152, 153, the base portion 100 (and the container 1 as a whole) may have an at least substantially ovular shape having a major axis parallel with the plane of symmetry A and a minor axis perpendicular to the plane of symmetry A. In the illustrated embodiments, the ratio between the length of the major axis and the minor axis is between about 1.016 to 1, although other ratios may be used based on needed interior dimensions of the container 1.

In the illustrated embodiment of FIGS. 1-7, the base portion 100 defines a support ring 101 defining an at least substantially ovular and planar support surface on which the container 1 rests when supported in the upright configuration on a horizontal support surface (e.g., at least substantially perpendicular to the sidewall 11). In various embodiments, the support ring 101 defines the bottom-most plane of the container 1, such that other contours present in the base portion 100 extend upward and inward toward the interior of the container 1.

As shown in FIGS. 2-3, the base portion 100 defines a channel portion 105-106 extending through the support ring 101 and across the entirety of the base portion 100. The channel portion 105-106 may be aligned with the symmetry plane A, such that a centerline of the channel portion 105-106 is aligned with the symmetry plane A (and the major axis of the ovular container 1). In the illustrated embodiment of FIG. 3, the channel portion 105-106 has a width (measured across the channel portion 105-106 and perpendicular to the plane of symmetry A) of between 1" to 2.5" (e.g., 2 inches). The channel portion 105-106 may have a depth of between 0.02" to 0.08" (e.g., 0.39 inches). The channel portion may also define an at least substantially continuous, concave radius of curvature of between about 1" to 18" (e.g., 16 inches). Because the channel portion 105-106 intersects the support ring 101 across the entirety of the diameter of the base portion 100, the support ring 101 effectively forms two symmetrical support portions on which the container 1 is supported in an upright orientation. Each of the symmetrical support portions of the support ring 101 may form substantially "C"-shaped support portions, having opposite ends of each support portion bounded by each of the channel portions 105-106.

Moreover, the base portion defines an inset portion 102 circumscribed by the support ring 101. As shown in the figures, the inset portion 102 may comprise an at least substantially ovular panel inset relative to the support ring 101 toward the interior of the container. The at least substantially ovular panel 102 may be concave, having a center point that is inset toward the interior of the container 1 relative to the edges of the concave panel 102 (the edges of the concave panel 102 may be provided within a single horizontal plane). In various embodiments, the center point of the concave panel 102 may be inset by a distance of between about 0.1" to 0.2" relative to the edges of the concave panel 102. Moreover, the edges of the concave panel 102 may be inset relative to the support ring 101 by a distance of between about 0.25" to 0.3". However, it should be understood that the concave panel 102 may be inset relative to the support ring 101 to vary the interior volume of the container 1, and accordingly the inset distance may be set according to a desired interior volume of the container 1. In certain embodiments, the outer edge of the concave panel 102 may define a transition curvature to the support ring 101, and may have a radius of curvature of at least about 0.125" to 0.25". The concave panel 102 may be centrally located within the base portion 100 (e.g., such that a centerpoint of the concave panel 102 is aligned with a centerline of the container 1) and may have a shape corresponding to the ovular shape of the container 1. For example, the concave panel 102 may have a ratio between a major axis and a minor axis that is at least substantially identical to the container 1. In such embodiments, the support ring 101 has an at least substantially uniform width around the perimeter of the base portion 100.

Because the concave panel 102 is located centrally within the support portion 101 of the container 1, the concave panel 102 segments the channel portion 105-106 into a first channel portion 105 and a second channel portion 106, wherein the first and second channel portions 105-106 are positioned on opposite sides of the concave panel 102 and are aligned with the plane of symmetry A.

Moreover, in the embodiment shown in the figures, the concave panel 102 comprises an alignment indenture 103. The alignment indenture 103 may be embodied as a cavity extending toward the interior of the container 1, and may be defined at least in part by an at least substantially vertical sidewall that may be configured to engage an alignment pin of a bottle fill machine. The alignment indenture 103 may be configured to facilitate rotating the container 1 into a desired alignment along a bottle fill line.

Vertical Portion 200

In the illustrated embodiment of FIGS. 1-7, the container 1 defines a vertical portion 200 extending between the base transition region 150 and the top transition region 300. The vertical portion 200 may be defined by portions of the sidewall 11 having an at least substantially vertical orientation (while the container 1 is in the upright configuration). As shown in the embodiment of the Figures, the portions of the container sidewall 11 within the vertical portion 200 may have an ovular configuration corresponding to the ovular shape of the base portion 100 and base transition region 150. For example, a horizontal cross section of the vertical portion 200 may define a ratio between a major axis and a minor axis that is at least substantially identical to the corresponding ratio of the base transition region 150. However, both the major axis and the minor axis of the vertical portion 200 may be smaller than an adjacent portion of the base transition region 150 and top transition region 300, thereby providing an inset vertical portion 200. In the illustrated embodiment, the vertical portion 200 meets the base transition region 150 at a lower bridge portion 201 joining the larger-diameter base transition region 150 with the smaller diameter vertical portion 200. In certain embodiments, the lower bridge portion 201 may be curved (e.g., a convex or concave curve) or chamfered as shown in the figures.

The vertical portion 200 may be configured for accepting a label printed, adhered, or otherwise secured thereon. For example, a separate label having a circumference at least substantially identical to the circumference of the vertical portion 200 may be positioned over the vertical portion 200 of the container 1. Because the vertical portion 200 may be inset relative to adjacent portions of the container, the separate label need not be directly secured onto the container sidewalls 11, and may be retained on the vertical portion 200 due to the relative size of the label (having a circumference substantially similar to the circumference of the vertical portion 200) relative to the sizes of the container portions immediately adjacent the vertical portion 200. For example, the label may be free to rotate around the vertical portion 200 and/or to slide along the height of the vertical portion between the lower bridge portion 201 and the upper bridge portion 202.

Top Transition Region 300

In the illustrated embodiment of FIGS. 1-7, the top transition region 300 may be defined between the vertical portion 200 and the top portion 400, and may thereby define the transition between the sidewall 11 within the vertical portion 200, and the planar, non-vertical portions of the sidewall 11 within the top portion 400.

In various embodiments, the top transition region 300 defines a gradually variable radius of curvature between the portion of the sidewall 11 in the vertical portion 200 and the non-vertical portion of the sidewall 11 within the top portion 400. As a non-limiting example, the top transition region 300 has a continuously variable radius of curvature (although in certain embodiments the top transition region 300 may define a continuous radius of curvature portion and a linear portion). In various embodiments, the top transition region 300 has a height (measured vertically between beginning of the radius of curvature at the top edge of the vertical portion 200 and the ending of the radius of curvature at the lower-most edge of the top portion 400 of 3.3" to 3.4". Moreover, the top portion may extend at an angle with respect to horizontal of at least approximately 57 degrees. This gradual and continuously variable radius of curvature of the top transition region 300 over the height of the top transition region 300 facilitates movement of container material across the top transition region 300 between the top portion 400 and the vertical portion 200 during formation of the container 1 in order to provide an at least substantially uniform wall thickness across all of the top portion 400, the top transition region 300, the vertical portion 200 and the base portion 100.

In various embodiments, the top transition region 300 has a variable and gradual radius of curvature along the entire height of the top transition region 300 (with the exception of the upper bridge portion 202 discussed herein). For example, the radius of curvature of the top transition region 300 may linearly increase and/or linearly decrease over the height of the top transition region 300. The top transition region 300 may also have a decreasing (e.g., continuously decreasing) diameter between a bottom portion of the top transition region 300 and the top portion 400, such that the container sidewall 11 may begin converging toward the spout 500.

In the illustrated embodiment of the figures, the top transition region 300 has an overall diameter larger than the adjacent vertical portion 200 (e.g., the top transition region 300 may have an overall diameter at least substantially the same as the base transition region 150), and thus the top transition region 300 may additionally comprise an upper bridge portion 202 connecting the vertical portion 200 with the top transition region 300. The upper bridge portion 202 may have a configuration at least substantially the same as the lower bridge portion 201. In certain embodiments, the upper bridge portion 202 may be chamfered or curved (e.g., a convex curve or a concave curve) as shown in the figures.

The top transition region 300 may additionally comprise one or more spacing portions 302, 303 corresponding to the spacing portions 152, 153 of the base transition region 150. In the illustrated embodiments, the spacing portions 302, 303 comprise first spacing portions 302 and second spacing portions 303 that may be aligned with the first spacing portions 152 and second spacing portions 153, respectively, of the base transition region 150. The first spacing portions 302 have a first width (measured along the circumference of the top transition region 300) and the second spacing portions 303 have a second width (measured along the circumference of the top transition region 300). The first width and the second width may correspond to the respective first width and second width of the first spacing portions 152 and second spacing portions 153 within the base transition region 150. The spacing portions 302, 303 may be spaced evenly around the perimeter of the top transition region 300. For example, the spacing portions 302, 303 may be spaced at approximately 90 degrees around the perimeter of the top transition region 300. Moreover, the spacing portions 302, 303 may converge within the top portion 400 toward the spout, as the cross-sectional area of the top portion 400 decreases toward the spout.

Moreover, as will be discussed in greater detail herein, at least a portion of the top transition region 300 may be interrupted by the handle portion 600. Accordingly, the top transition region 300 may extend partially around the perimeter of the container 1 between opposite side edges of the handle portion 600.

Top Portion 400

In the illustrated embodiment of FIGS. 1-7, the top portion 400 may be defined between the top transition region 300 and the spout 500. In the illustrated embodiments, the top portion 400 of the sidewall are curved around the perimeter of container 1, and are linear in a direction toward the spout 500. The sidewall 11 thus converges and slopes upward toward the spout 500 of the container 1 along the length of the top portion 400 (e.g., between the lowermost edge of the top portion 400, defined by the boundary with the top transition region 300, and the spout 500).

In the illustrated embodiments, the top portion 400 is separated from the top transition region 300 by a slope transition 401 positioned between the top portion 400 and the top transition region 300. As mentioned above, the top transition region 300 may be defined by a continuously variable radius of curvature between the vertical portion 200 and the top portion 400. For example, the radius of curvature of the top transition region 300 may increase from the vertical portion 200 to the top portion 400, such that the top transition region 300 is approximately linear proximate the top portion 400. In certain embodiments, the top portion 400 may be defined by a steeper slope (e.g., a more acute angle relative to vertical) than the portion of the top transition region 300 proximate the top portion 400. The change in slope between the top portion 400 and the top transition region 300 may increase the top load crush resistance of the container 1 by providing a load-bearing top portion 400 that directs vertical crushing forces away from the spout 500 and the interface between the spout 500 and the top portion 400, and acts to spread the vertical crushing forces over a large portion of the sidewall 11, particularly within the top transition region 300 of the container 1.

In certain embodiments, the ratio between the vertical height of the top transition region 300 and the top portion 400 is at least approximately 2.7 to 1. For example, the top transition region 300 may have a vertical height of at least approximately 3.3, and the top portion 400 may have a vertical height of at least approximately 1.25. Moreover, as mentioned above, the top portion 400 may define an angle relative to horizontal of at least approximately 57 degrees. In certain embodiments, the portion of the top transition region 300 immediately adjacent the slope transition 401 may define a less-steep angle relative to horizontal. However, it should be understood that in certain embodiments, the portion of the top transition region 300 immediately adjacent the slop transition 401 may define an angle relative to horizontal that is at least approximately equal to the angle of the top portion 400.

Collectively, the top portion 400 and the top transition region 300 collectively define at least approximately 40% percent of the total height of the container (measured between the support ring 101 of the base portion 100 to the top of the spout 500). By providing such a large percentage of the container 1 height within the top portion 400 and top transition region 300, the container 1 may have a gradual diameter increase from the spout 500 to the vertical portion 200. This gradual increase in diameter is characterized by a relatively steep slope of the top portion 400 and top transition region 300 which is configured to support a larger portion of a vertical compressive force applied to the spout and to distribute the received compressive load over a larger surface area of the container sidewall 11. The gradual increase in diameter prevents the formation of localized stress points within the top portion 400 of the container that subject to relatively high compressive forces when the container is subject to a vertical compressive load.

Spout 500

In various embodiments, the spout 500 extends above the top portion 400, and forms an opening from which the contents of the container 1 may be added to the container and/or removed from the container 1. The spout 500 may define a raised shoulder 501 surrounding the spout 500 and intersecting the top portion 400 (e.g., intersecting the second slope portion 402). The raised shoulder 501 may extend between the top portion 400 and a neck 502 extending at least substantially vertically from the raised shoulder 501.

The raised shoulder 501 may be angled relative to horizontal, defining an angle of between about 20 to 55 degrees relative to horizontal.

The neck may extend upward to a cap engagement portion 504 defining one or more threads, nipples, and/or the like to engage a removable cap (not shown) such that the removable cap may be selectably secured to the container 1. In various embodiments, one or more portions of the spout 500 may have a wall thickness greater than the wall thickness of remaining portions of the container 1. Particularly in embodiments comprising a threaded cap engagement portion 504, the cap engagement portion 504 may not be symmetrical across the container symmetry plane A.

Moreover, in certain embodiments, the spout 500 may be configured to provide additional rigidity to the container 1 while a cap is secured thereto. Accordingly, the container 1 may have a higher crush resistance strength while the cap is secured relative to the spout.

Figure 4:
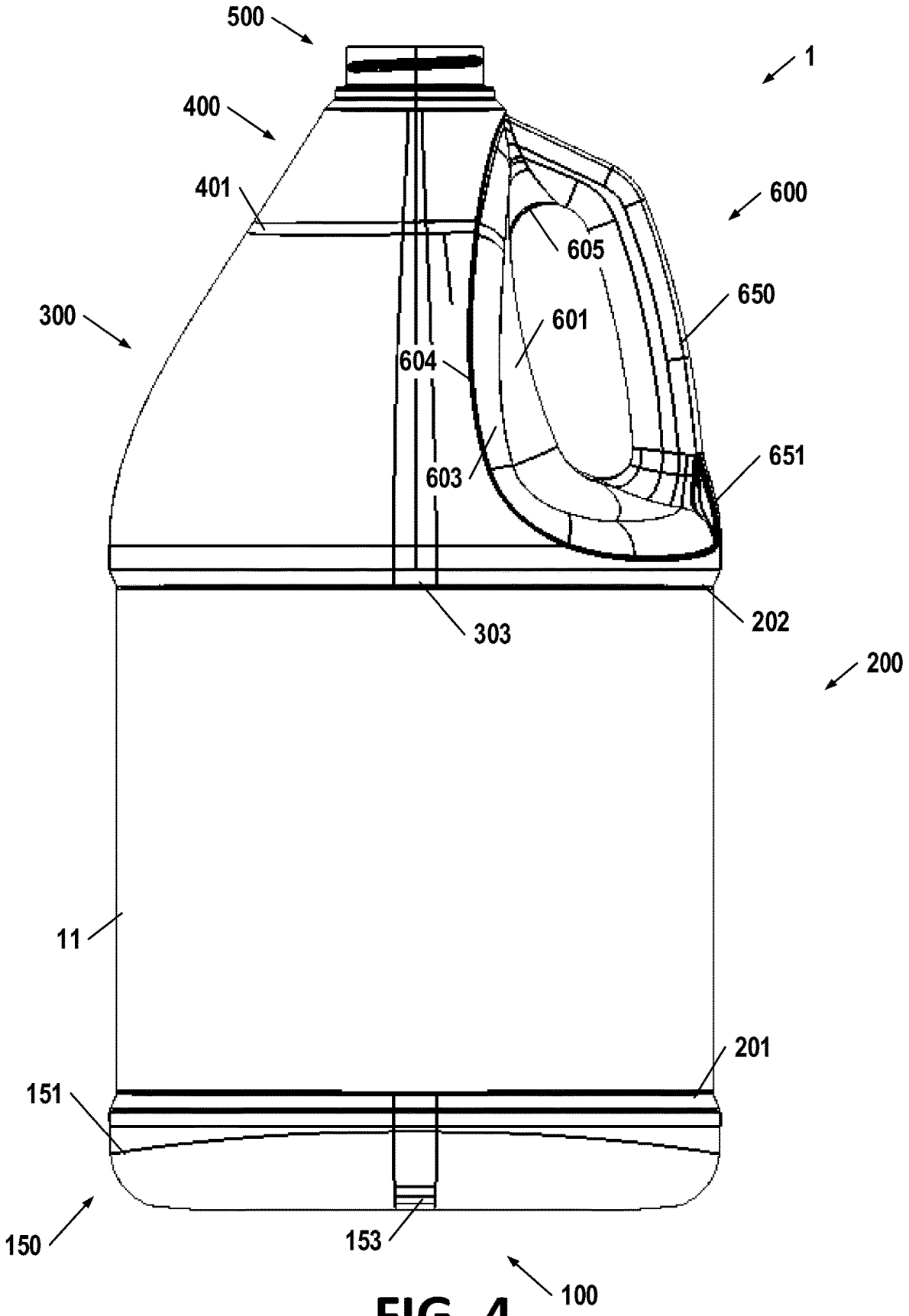
Figure 7:
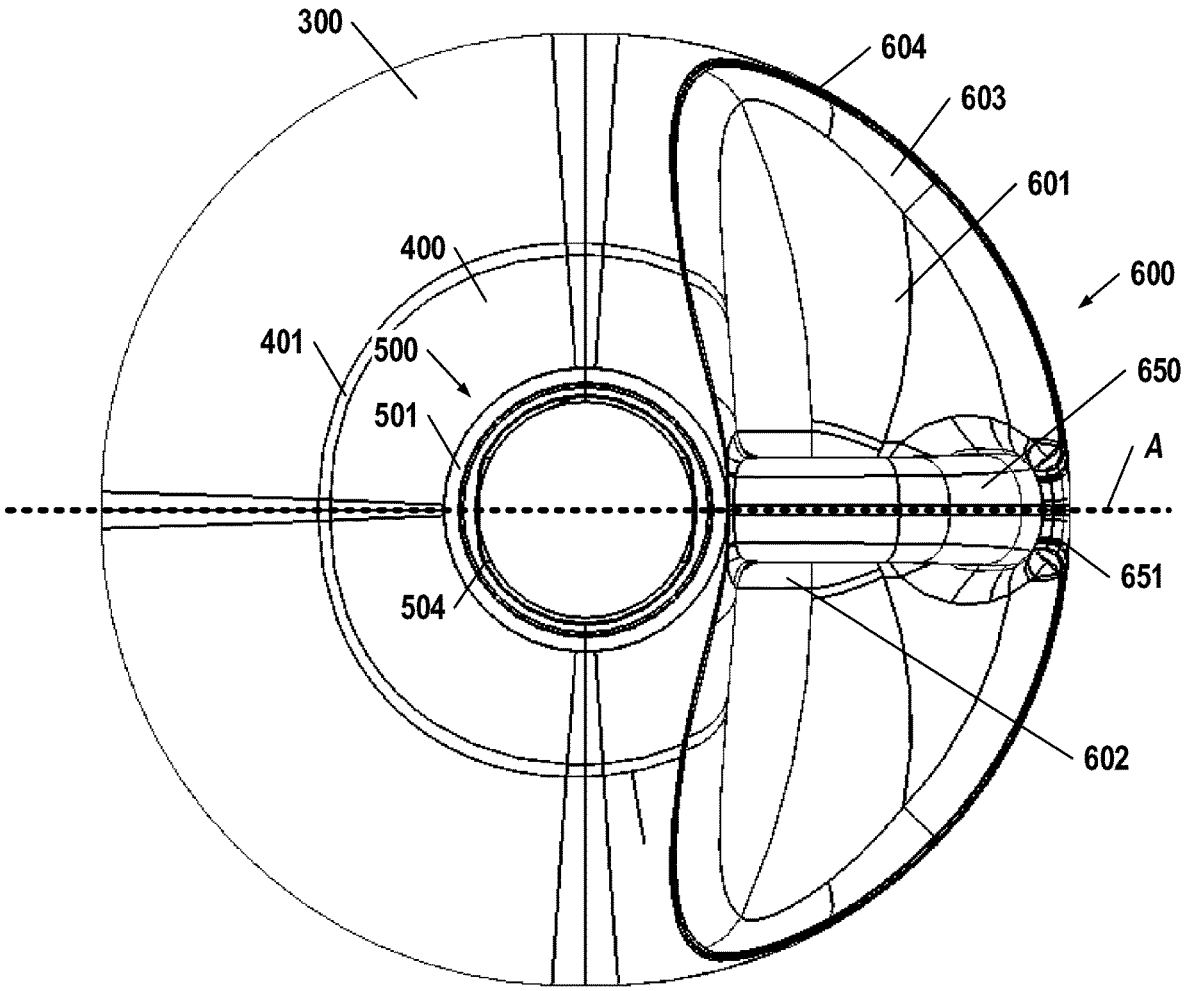

In various embodiments, the spout 500 may be located at least substantially centrally with respect to the profile of the container 1. As shown in FIGS. 4-5 and 7, the spout 500 may be centrally located relative to the container 1, such that a centerline of the spout 500 is at least substantially aligned with a centerline of the container 1 and a centerline of the base portion 100. Accordingly, the spout 500 may be spaced at least substantially equally from vertical portions of opposite pairs of sidewalls 11-18 (and accordingly opposing portions of the perimeter of the base portion 100) of the container 1.

Handle Portion 600

As mentioned herein, the container 1 may additionally comprise a handle portion 600. In the illustrated embodiment of FIGS. 1-7, the handle portion occupies a portion of the container 1 within the top transition region 300 and the top portion 400 and thereby defines a handle cavity that provides a discontinuity within the top transition region 300 and the top portion 400. The handle portion 600 is defined by a face surface 601 that spans the width of the handle cavity between opposite edges of the top transition region 300 and top portion 400, and a handle 650 that intersects the face surface 601 at a top end and a bottom end. The handle 650 extends away from the face surface 601 providing a gap between the handle 650 and the face surface 601 configured such that a user can grasp the handle 650 by wrapping the user's hand entirely around the handle 650. The handle portion 600 is aligned with the plane of symmetry A such that both the handle 650 and face surface 601 are intersected by the plane of symmetry A.

As shown in the figures, the face surface 601 defines a plurality of complex curved surfaces configured to spread vertical crushing loads across a large surface area of the container 1. The face surface generally slopes away from a central portion (aligned with the handle 650 and the plane of symmetry A) and toward the top portion 400 and top transition region 300. The face surface 601 thus has a generally convex cross-sectional shape for the container 1. Moreover, the face surface 601 defines a plurality of convex surfaces, such that the horizontal cross-sectional shape of the face surface 601 varies along the height of the face surface 601. The face surface 601 also defines an obtuse "L" shape over the height of the face surface 601. As shown in the attached figures, the face surface 601 defines a lower portion angled at an obtuse angle relative to an upper portion (the lower portion being separated from the upper portion by a curved portion as discussed herein).

As shown in FIG. 1, the upper portion of the face surface 601 defines a central portion 602 having a simple-curved surface defining a concave surface having a radius of curvature of between about 2" to 6" (e.g., a variable radius of curvature between about 2" to about 6"). The simple-curved surface is aligned with the plane of symmetry A, and extends between the top end of the handle 650 to a face surface transition portion between the upper portion and the lower portion of the face surface. The face surface transition portion defines a concave radius of curvature surface extending to the bottom end of the handle 650. The horizontal-transition portion has a smaller radius of curvature than the simple-curved surfaces, such that the face surface 601 transitions to the lower portion proximate the bottom end of the handle 650.

In various embodiments, the vertical cross-sectional shape of the central portion of the upper portion and the face surface transition portion (e.g., a cross-section taken within a plane parallel with the plane of symmetry A and within the width of the central portion) is at least substantially continuous across the width of the central portion. In certain embodiments, the central portion may be sloped away from the plane of symmetry A with an at least substantially constant slope (e.g., uncurved away from the plane of symmetry A) while maintaining an at least substantially continuous vertical-cross section of the central portion within a plane parallel with the plane of symmetry A.

Outside of the width of the central portion, the upper portion and the lower portion of the face surface 601 define complex, convex curves that slope away from the plane of symmetry A and slope downward toward the vertical portion 200 of the container 1. Due to the complex nature of the curves of the face surface 601 outside of the width of the central portion, the vertical cross section shape (measured in a plane parallel with the plane of symmetry A) and the horizontal cross sectional shape (measured in a horizontal plane perpendicular with the plane of symmetry A) change over the width of the face surface 601 and height of the face surface 601, respectively.

As shown in the figures, the face surface 601 is bounded by a convex perimeter curve 603 joining the face surface 601 with adjacent portions of the top portion 400 or top transition region 300. The convex perimeter curve is configured to increase the strength (e.g., the top load crush resistance strength) of the container by distributing received loads over a wide surface area of the container 1. The convex perimeter curve 603 has a radius of curvature of between about 0.4" to 0.5" (e.g., 0.041" inches), and may vary around the perimeter of the face surface 601. Moreover, the linear width of the convex perimeter curve 603 may be between about 0.3" to 0.5", measured along a line extending perpendicular to the lateral edge of the face surface 601.

Moreover, the convex perimeter curve 603 of the handle portion 600 is bounded by a perimeter groove 604 circumscribing the handle portion 600. In the illustrated embodiment of the figures, the perimeter groove 604 has a depth of between about 0.03" to 0.045" (e.g., 0.039 inches), and a width (measured across the perimeter groove 604) of at least about 0.07" to 0.08".

As shown in the figures, the handle 650 extends from the upper end, along a generally obtuse and inverted "L"-shaped profile, and to the lower end, thereby forming the gap between the obtuse "L"-shaped face surface 601 and the inverted and obtuse "L"-shaped handle 650. Moreover, the handle 650 may have a rounded rectangular cross-section (e.g., defined by perpendicular pairs of parallel sidewalls joined by rounded corners) and may be hollow, having a sidewall thickness at least substantially similar to the sidewall thickness of the container 1 as a whole. In certain embodiments, the outermost sidewall of the handle may have a non-linear profile, and may form an at least substantially obtuse sidewall to provide additional strength against deformation of the handle when used to support the weight of a filled container 1.

The upper end of the handle 650 may be defined by a concave handle perimeter curve circumscribing the handle 650 and joining the sidewalls of the handle with the face surface 601, convex perimeter curve 603, and/or perimeter groove 604. As shown in the figures, the handle 650 intersects the convex perimeter curve 603 at the upper end, and therefore the concave handle perimeter curve intersects the convex perimeter curve 603 and perimeter groove 604. The concave handle perimeter curve remains within the handle portion 600 however, as defined by an outer edge of the perimeter groove. Moreover, the concave handle perimeter curve may have a radius of curvature of between about 0.18" to 0.45", and may vary around the perimeter of the handle 650.

As shown in the figures, the upper end of the handle 650 may additionally define a handle rib 605 centered on the plane of symmetry A and extending along the length of the concave handle perimeter curve. The handle rib 605 may have a width (measured across the plane of symmetry A) of between about 0.04" to 0.08", and a maximum height (measured perpendicular to the surface of the concave handle perimeter curve) of between about 0.02" to 0.08". The handle rib 605 may be configured to provide additional crush resistance strength at an anticipated stress point along an interior surface of the handle 650.

The lower end of the handle 650 may be defined by a lower concave handle perimeter curve circumscribing the handle 650 and joining the sidewalls of the handle 650 with the face surface 601, convex perimeter curve 603, and/or perimeter groove 604. As shown in the figures, the handle 650 intersects the convex perimeter curve 603 at the lower end, and therefore the lower concave handle perimeter curve intersects the convex perimeter curve 603. Moreover, as shown in the figures, the lower end of the handle 650 is partially bounded by a protruding strap portion 651 extending between the outer edge of the perimeter groove 604 and the lower end of the handle 650. The protruding strap portion 651 has a convex profile (parallel with the plane of symmetry A) and is configured to distribute the portion of vertical crushing forces transmitted from the container spout 500 along the handle 650 to avoid a compressive stress concentration point at the lower end of the handle 650. The protruding strap portion 651 interrupts the perimeter groove 604 such that compressive forces transmitted along the length of the handle 650 are distributed over the sidewall 11, and are not concentrated within the perimeter groove 604. Like the remaining portions of the handle 650 (including both the upper end and the lower end of the handle 650), the protruding strap portion 651 may be hollow and may have a sidewall thickness at least substantially equal with the sidewall thickness of the remaining portions of the container 1.

As shown in the side-view of FIG. 4, the face surface 601 and handle 650 are spaced a horizontal distance away from the spout 500. Specifically, the face surface 601 and handle 650 are horizontally spaced away from a vertical plane that is tangent to a portion of the spout and perpendicular to the plane of symmetry A. This orientation of the handle portion 600 that places the handle 650 and face surface 601 outward of the perimeter of the spout 500 avoid compressive stress concentration points within the handle portion 600 when the container 1 is subject to vertical compressive forces onto the spout 500 (e.g., while compressing a snap-fit cap onto the spout 500). By distributing vertical compressive forces on the container 1 over a large surface area of the container sidewall 11, the orientation of the handle portion 650 relative to the spout 500 increases the overall compressive strength of the container 1 relative to containers having similar sidewall thicknesses.

As mentioned herein, the container 1 may have an ovular shape mirrored about the plane of symmetry A, and having a major axis aligned with the plane of symmetry A and a minor axis perpendicular to the plane of symmetry A. In such embodiments, the handle 650 is aligned with the major axis of the container 1.

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A container comprising:

a base portion configured to support the container in an upright orientation relative to a support surface and wherein the base portion defines an at least substantially ovular perimeter;

a spout positioned opposite the base portion and oriented such that a centerline of the spout is aligned with a centerline of the base portion; and an ovular sidewall extending between the perimeter of the base portion to the spout, wherein the ovular sidewall defines:

a vertical portion extending away from the base portion;

a downward sloping linear top portion extending away from the spout and toward the vertical portion, wherein the downward sloping linear top portion is a part of the ovular sidewall; and a gradually curved transition region extending between the vertical portion and the downward sloping linear top portion;

a handle portion positioned at least partially within the downward sloping linear top portion and the gradually curved transition region; and a cap detachably secured relative to the spout to entirely enclose an interior of the container;

wherein the ovular sidewall and the handle portion define an at least substantially uniform wall thickness of at least approximately 0.009-0.050 inches; and wherein the container is configured to resist a vertical crushing force of at least approximately between 150-160 lbf of force with about a ¼" deflection in overall height of the container when filled.

2. The container of claim 1, wherein the container comprises a high-density polyethylene material.

3. The container of claim 1, wherein the container is symmetrical about a container symmetry plane extending through the spout and the handle portion.

4. The container of claim 1, wherein the handle portion defines:

a handle cavity;

a face surface extending across the handle cavity; and a handle comprising an upper portion adjacent the spout and a lower portion adjacent the vertical portion of the sidewall.

5. The container of claim 4, wherein the handle portion further defines a handle rib protrusion aligned with a centerline of the handle.

6. The container of claim 4, wherein a lower end of the handle is bounded by a protruding strap portion configured to distribute at least a portion of a vertical crushing force transmitted along the handle from the spout over the ovular sidewall.

7. The container of claim 6, wherein the protruding strap portion is hollow.

8. The container of claim 4, wherein the base portion defines a major diameter measured across the container and aligned with a first center plane of the container and a minor diameter measured across the container and aligned with a second center plane perpendicular to the first center plane, wherein the major diameter is longer than the minor diameter; and wherein the handle is aligned with the first center plane.

9. The container of claim 8, wherein the handle and face surface are spaced a horizontal distance away from a third plane, wherein the third plane is parallel with the second plane and tangent to the spout such that the spout is positioned on a first side of the third plane and the handle and face surface are positioned on a second side of the third plane.

10. The container of claim 4, wherein the face surface is bounded by a convex perimeter curve joining the face surface with the downward sloping linear top portion and the gradually curved transition region.

11. The container of claim 10, wherein the convex perimeter curve is bounded by a perimeter groove positioned between the convex perimeter curve and the downward sloping linear top portion and gradually curved transition region.

12. The container of claim 11, wherein an upper portion of the handle intersects the convex perimeter curve at a first position proximate the spout and a lower portion of the handle intersects the convex perimeter curve at a second position proximate the vertical portion of the sidewall.

13. The container of claim 1, wherein the gradually curved transition region defines a continuously variable radius of curvature having an at least substantially linear portion adjacent the downward sloping linear top portion.

14. The container of claim 1, wherein the vertical portion is inset relative to the gradually curved transition region and the base portion.

15. A container comprising:

a base portion configured to support the container in an upright orientation relative to a support surface and wherein the base portion defines an at least substantially ovular perimeter;

a spout positioned opposite the base portion and oriented such that a centerline of the spout is aligned with a centerline of the base portion; and an ovular sidewall extending between the perimeter of the base portion to the spout, wherein the ovular sidewall defines:

a vertical portion extending away from the base portion;

a downward sloping linear top portion extending away from the spout and toward the vertical portion, wherein the downward sloping linear top portion is a part of the ovular sidewall; and a gradually curved transition region extending between the vertical portion and the downward sloping linear top portion, wherein the gradually curved transition region defines a continuously variable radius of curvature having an at least substantially linear portion adjacent the downward sloping linear top portion;

wherein the downward sloping linear top portion has a steeper slope than at least a portion of the gradually curved transition region; and a cap detachably secured relative to the spout to entirely enclose an interior of the container;

wherein the ovular sidewall defines an at least substantially uniform wall thickness through the vertical portion, gradually curved transition region, and downward sloping linear top portion of at least approximately 0.009-0.050 inches; and wherein the container is configured to resist a vertical crushing force of at least approximately between 150-160 lbf of force with about a ¼" deflection in overall height of the container when filled.

16. The container of claim 15, wherein the container comprises a high-density polyethylene material.

17. The container of claim 15, wherein the vertical portion is inset relative to the gradually curved transition region and the base portion.

18. The container of claim 17, wherein the ovular sidewall further comprises a curved bridge portion connecting the vertical portion and the gradually curved transition region.

19. The container of claim 15, wherein the downward sloping linear top portion defines an angle relative to horizontal of at least approximately 57 degrees.

20. The container of claim 15, wherein the ovular sidewall further defines a curved base transition region extending between the base portion and the vertical portion, and wherein the vertical portion is inset relative to the curved base transition region.

* * * * *